US005555693A

United States Patent [19]

Sorkin

[11] Patent Number: 5,555,693

[45] Date of Patent: Sep. 17, 1996

[54] CHAIR FOR USE IN CONSTRUCTION

[76] Inventor: Felix L. Sorkin, 4115B Greenbriar Dr., Stafford, Tex. 77477

[21] Appl. No.: 372,053

[22] Filed: Jan. 12, 1995

[51] Int. Cl.[6] ..... E04C 5/20

[52] U.S. Cl. ..... 52/689; 52/679; 52/687; 404/135

[58] Field of Search ..... 52/677, 679, 680, 52/681, 682, 683, 684, 685, 686, 687, 688, 689, 678, 700; 404/134, 135, 136; D8/354, 380

[56] References Cited

U.S. PATENT DOCUMENTS

| | | | |
|---|---|---|---|
| D. 334,133 | 3/1993 | Hartsheim . | |
| 1,592,681 | 7/1926 | Grothe | 52/700 |
| 4,000,591 | 1/1977 | Courtois | 52/689 |
| 4,483,119 | 11/1984 | Hernandez | 52/689 |
| 4,682,461 | 7/1987 | Sizemore | 52/689 |
| 4,756,641 | 7/1988 | Hartzheim | 52/689 |

FOREIGN PATENT DOCUMENTS

| | | | |
|---|---|---|---|
| 227969 | 5/1960 | Australia | 52/689 |
| 575043 | 1/1946 | United Kingdom | 52/678 |

OTHER PUBLICATIONS

AZTEC Concrete Accessories Catalog, 1994.

Meadow Steel Products Price List, 1994, pp. 1–7.

MEDCO "Plastic Accessories Catalog" 1991 pp. 1–5.

*Primary Examiner*—Michael Safavi

*Attorney, Agent, or Firm*—Harrison & Egbert

[57] ABSTRACT

A chair for use in construction including a receiving area and a plurality of legs extending downwardly from the receiving area. Each of the plurality of legs has a foot extending horizontally outwardly therefrom. The foot of one of the legs is separate from the foot of an adjacent leg. The receiving area and the plurality of legs are integrally formed together of a polymeric material. The receiving area has a generally parabolic indentation. A first pair of the plurality of legs extends in a plane transverse to a second pair of the legs. Each of the feet has a planar bottom surface with a projection extending downwardly therefrom. A projection is integrally formed with the feet.

10 Claims, 1 Drawing Sheet

CHAIR FOR USE IN CONSTRUCTION

TECHNICAL FIELD

The present invention relates generally to chairs and spacers that are used in construction activities for the support of post-tension cables, rebars, or mesh. More particularly, the present invention relates to chairs of plastic construction that are used for the support of such materials in poured decks and precast work.

BACKGROUND ART

Chairs are commonly used in the construction industry for the support of post-tension cables, rebars, and mesh above a surface. Typically, when such materials are used, they must be supported above the surface when the concrete is poured. Chairs are used with poured decks, precast work, and slab-on-grade applications. In normal use, a receiving area formed on the chair will contact and support the rebar while the base of the chair rests on a deck or on a grade. When the concrete is poured, the chair will support the post-tension cable or rebar a proper distance above the bottom surface.

In deck applications, the most common chair that is employed is a metal chair manufactured by Meadow Steel Products of Tampa, Fla. This chair is made from a pair of bent wires. A first bent wire has a receiving area for the receipt of the rebar. The receiving area is bent into the wire so as to form a generally parabolic indentation. The ends of the wire are bent at a ninety degree angle so as to support the wire in an upright condition above the deck. A second wire is formed in an inverted U-shaped configuration and is welded to the bottom edge of the receiving area of the first wire. The second wire also has ends that are bent at generally ninety degree angles. The first wire will extend in a plane transverse to the second wire such that the first and second wire form the "legs" of the chair. The ends of each of these wires will rest on the deck while the table is supported. After the concrete has solidified, and the deck is removed, the bottom surfaces of the ends of the wire will be exposed. As such, it is necessary to coat the ends of the wires with an anti-rust material. The rebar can be tied to the receiving area.

In normal applications, this Meadow Steel Products' chair will support a single rebar above the deck for a desired distance. However, in other applications, it is often desirable to place a second smaller chair beneath the larger chair so that another additional rebar can be extended so as to intersect with the first rebar. The chairs come in a large number of sizes and heights. In some circumstances, it is often desirable to place more than one rebar into the receiving area of the chair. To accommodate this problem the receiving area of the chair has a generally parabolic indentation.

Corrosion and cost are major problems affecting the Meadow Steel Products' chair. In order to form such a chair, a great deal of manufacturing must take place, including metal forming, bending, dipping, and welding. These activities, along with the cost of the material used to form the chair, make the cost of the chair relatively expensive. If the Meadow steel chair is not coated, then corrosion can adversely affect the product. Such corrosion can occur even in coated metal chains.

In the past, many attempts have been made to create chairs of plastic material that can serve the purposes of the Meadow Steel Products' chair. In general, such efforts have resulted in plastic chairs that are ineffective, cumbersome to use, or unable to withstand the forces imparted by the cable upon the chair. In some cases, support rings and other structures have been placed upon the plastic chairs so as to give the chair sufficient strength. Unfortunately, as such structures are added to the plastic chair, it becomes increasingly difficult to tie the rebar to the receiving area of the chair. This often requires a threading of the wire through the interior of the plastic chair in order to tie the rebar. As a result of this complicated procedure, many construction workers have been unwilling to use such plastic chairs. Additionally, the interior structures and support rings of such plastic chairs eliminate the ability to extend the rebars in an intersected relationship since one chair cannot be stacked upon or over another.

The plastic chairs of the past have often broken, collapsed, or tipped over in actual use. In the case of the plastic chairs, the base of the chair has only a small area of contact with the deck. Even with the necessary internal structure, experience has shown that such plastic chairs fail to withstand the weight of the rebar.

One particular type of plastic chair that has had some success is manufactured by Aztec Concrete Accessories, Inc. of Fontana, Calif. This chair has a plurality of legs that extend downwardly from a central receiving area. The central receiving area has a generally semi-circular configuration that can receive only a single rebar. An annular ring extends around the legs of the chair so as to provide the necessary structural support for the chair. The feet of the chair extend inwardly of the ring. In use, these chairs have had a tendency to tip over. Additionally, these chairs fail to accommodate the need to align rebars in an intersected relationship. The use of the annular ring extending around the legs of the chairs requires that a wire must be threaded through the interior of the chair in order to tie the rebar within the receiving area. As such, these chairs have been generally ineffective for meeting the needs of the construction industry. In the past, these and other plastic chairs have been unable to withstand the loads placed upon them. As such, breakage and insufficient rebar support has resulted.

It is an object of the present invention to provide a chair that is corrosion-proof and relatively inexpensive.

It is another object of the present invention to provide a chair that facilitates the ability to stack the chairs.

It is a further object of the present invention to provide a chair that withstands the forces imparted on it.

It is a further object of the present invention to provide a chair that is easy to manufacture and easy to use.

It is still another object of the present invention to provide a chair that has a receiving area that can accommodate several rebars.

These and other objects and advantages of the present invention will become apparent from a reading of the attached specification and appended claims.

SUMMARY OF THE INVENTION

The present invention is a chair that comprises a receiving area and a plurality of separate legs extending downwardly from the receiving area. Each of the legs has a foot extending horizontally outwardly therefrom. The foot of each of these legs is separate from the feet of adjacent legs. The receiving area, the legs, and the feet are integrally formed together of a polymeric material. The receiving area has a generally parabolic indentation formed therein. A first pair of the plurality of legs extends downwardly from upper ends of the receiving area. A second pair of legs extends downwardly from the lower portion of the receiving area. The first pair of legs extend in a plane transverse to the second pair of legs.

Each of the feet has a generally planar bottom surface. This planar bottom surface has a projection extending downwardly therefrom. This projection should have a point opposite the planar bottom surface. This point should be sufficiently small so as to bite into the support surface below the chair. In the preferred embodiment of the present invention, the projection has an inverted pyramidal configuration. The planar bottom surface has a first projection adjacent an inner edge of the foot and a second projection adjacent the outer edge of the foot. The projection is integrally formed with the foot. Another projection may be interposed between the first and second projections on the planar bottom surface.

The polymeric material used in the present invention is a glass-filled nylon material.

DETAILED DESCRIPTION OF THE INVENTION

Figures 1, 2, 3:
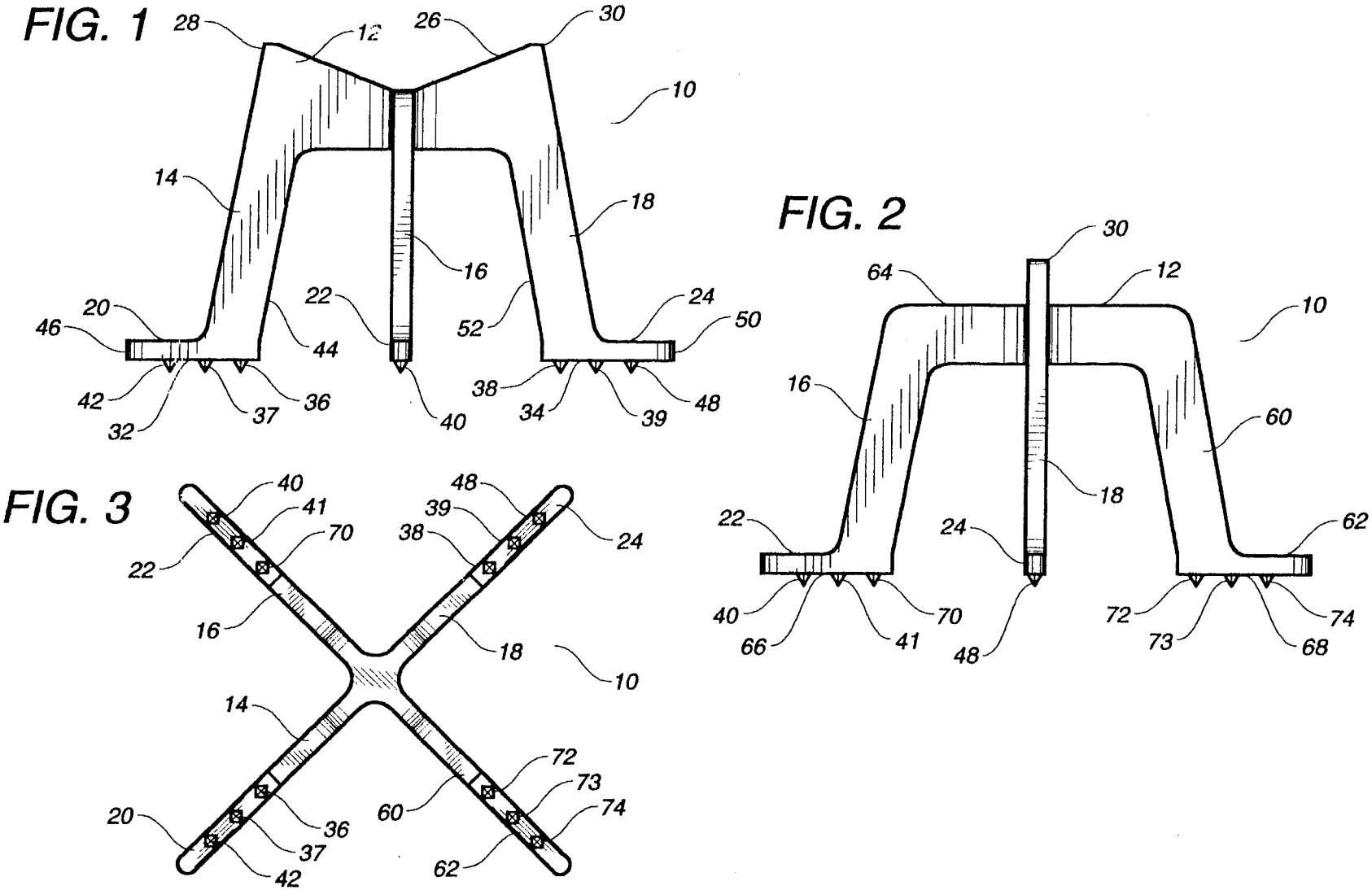
FIG. 1 is a side elevational view of the chair in accordance with the preferred embodiment of the present invention.
FIG. 2 is a front view of the chair of the present invention.
FIG. 3 is a bottom view of the chair of the present invention.

Referring to FIG. 1, there is shown at 10 the chair in accordance with the preferred embodiment of the present invention. The chair 10 includes a receiving area 12, and a plurality of legs 14, 16, and 18. It can be seen that the legs 14, 16, and 18 extend downwardly from the receiving area Leg 14 has a foot 20 extending outwardly horizontally therefrom. Leg 16 also has a foot 22 extending horizontally outwardly therefrom. Leg 18 has a foot 24 extending horizontally outwardly therefrom. In the preferred embodiment of the present invention, the receiving area 12, the legs 14, 16 and 18, and the feet 20, 22 and 24 are integrally formed together of a polymeric material. The legs are separate from each other below the receiving area 12.

The receiving area 12 has a top surface defining a generally parabolic indentation 26. Indentation 26 is suitable for the receipt of a post-tension cable or a rebar therein. If it is necessary to string additional rebars in a side-by-side relationship to the rebar in the bottom portion of the indentation 26, then the upper portions of the indentation 26 can accommodate such rebars thereon. It can be seen that the first leg 14 extends downwardly from the upper end 28 of the receiving area 12. Similarly, leg 18 also extends downwardly from the opposite upper end 30 of receiving area 12. Leg 16 extends downwardly from the lower central portion of the receiving area 12.

In FIG. 1, it can be seen that the legs 14 and 18 extend outwardly slightly angled (approximately ten degrees) from the vertical. The angling of legs 14 and 18 provides proper structural support for the receiving area 12.

Although the indentation 26 of the receiving area 12 is identified as a generally "parabolic" indentation, it is possible that, within the scope of the present invention, the sides of the indentation 26 can be straight so as to taper downwardly to the center bottom of the receiving area 12. In such an arrangement, the taper would generally extend at approximately twenty degrees to the horizontal.

It can be seen that the foot 20 has a generally planar bottom surface 32. The foot 24 also has a planar bottom surface 34. The planar bottom surfaces 32 and 34 have a horizontal orientation. A projection 36 extends downwardly from the bottom surface 32 of the foot 20. A projection 38 extends downwardly from the bottom surface 34 of the foot 20. Similarly, a projection 40 extends downwardly from the bottom surface of the foot 22. A second projection 42 also extends downwardly from the bottom surface 32 of the foot 20. The first projection 36 is positioned adjacent an inner edge 44 of the foot 20 while the second projection 42 is positioned adjacent an outer edge 46 of the foot 20. Similarly, the second foot 24 has a second projection 48 adjacent the outer edge 50 of the foot 24. The first projection 38 is positioned the inner edge 52 of the foot 24. An additional middle projection 37 is formed on planar bottom surface 32 between projections 36 and 42. Similarly, a projection 39 is formed on the planar bottom surface 34 between projections 38 and 48. Each of the projections 36, 37, 38, 39, 42 and 48 have an inverted pyramidal configuration. These projections are integrally formed with the feet 20 and 24. The projections have a point at the bottom of sufficient sharpness so as to bite into a surface supporting the chair 10 when the chair 10 is under a load.

Importantly, the configuration of the projections 36, 37, 38, 39, 42 and 48 enhances the structural stability and strength of the chair 10 of the present invention. Whenever a load is applied to the receiving area 12 of the chair 10, then this load will cause the projections to bite, to engage or to become embedded in the deck under which the chair 10 is placed. As such, the projections will facilitate the ability of the legs 14 and 18 to resist deformation under the presence of a load. As a result, it is possible to create the chair 10 without having an internal structural ring or other structural members. The horizontally outwardly extending feet 20 and 24, in combination with the projections 36, 37, 38, 39, 42 and 48, enhance the stability of the chair 10 on the flat surface upon which it is placed. The projections help to support the vertical loads without horizontal deflections in the chair 10.

FIG. 2 shows an end view of the chair 10 of the present invention. It can be seen that the second pair of legs 16 and 60 extend outwardly from the central bottom of the receiving area 12. The legs 16 and 60 extend outwardly in a single plane transverse to the legs 14 and 18. Legs 16 and 60 are angled outwardly (in approximately twelve degrees to the vertical). Foot 22 extends horizontally outwardly from the leg 16. Foot 62 extending horizontally outwardly from the leg 60. In normal use, the top edge 64 of the legs 16 and 60 will be aligned with the cable extending within the receiving area 12. As such, this top edge 64 absorbs some of the forces imparted by the rebar upon the chair 10.

The feet 22 and 62 have flat planar bottom surfaces 66 and 68, respectively. Projections 40, 41 and 70 extend downwardly from the flat bottom surface 66 of foot 22. Projections 72, 73 and 74 extend downwardly from the flat planar surface 68 of the foot 62. The projections 40, 41, 70, 71, 72, and 74 have a configuration similar to that identified in FIG. 1. These projections also bite into the supporting surface so as to resist deflecting forces and serve to provide structural strength and integrity in the manner previously described in connection with FIG. 1.

FIG. 3 shows a bottom view of the chair 10. Particularly, in FIG. 3, it can be seen that the legs 14 and 18 are coplanar. Similarly, legs 16 and 60 are coplanar in a plane transverse to that of legs 14 and 18. In the present invention, the legs, the feet, and the projections are integrally formed together of a polymeric material. In the preferred embodiment of the present invention, the maximum amount of structural integrity and strength is obtained through the use of a glass-filled nylon material. It can be seen that the feet 20, 22, 24, and 62 extend horizontally outwardly from the legs. The use of such feet gives stability and spreads the forces imparted by the cable upon the receiving area over a larger area of the deck onto which such feet are placed.

Importantly, in the present invention, the feet 20, 22, 24, and 62 are configured so as to have a relatively narrow and short configuration. The width of the feet generally matches the thickness of the legs. As a result, it becomes possible to staple the feet to the deck upon which such feet are placed. The stapling of the feet to the deck assures that a deformation of the plastic chair 10 will not occur. Additionally, such stapling assures that the chair will not tip over, become dislodged, or moved from its desired location. The prior art configurations of plastic chairs have failed to provide for the stapleability of the feet of the chair.

The configuration of the embodiment of FIGS. 1–3 Greatly facilitates the installation and use of such chairs at the construction site. Since there are no interior structures on the chair, it is a relatively easy process to tie the rebar within the receiving area 12. The present invention eliminates the need to thread a wire through a complex interior structure. Since the present invention is manufactured through an injection molding process, each of the plastic chairs 10 is relatively inexpensive and corrosion-proof in comparison with conventional metal chairs. The use of plastic chairs eliminates the problems of corrosion or discoloring that can occur through the use of metal chairs. The absence of the interior support structure means that smaller chairs can be positioned on the interior of a larger chair so that the rebars can be aligned in parallel planar relationship or positioned in intersecting relationship.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A chair comprising:

a receiving area; and a plurality of separate legs extending downwardly from said receiving area, each of said legs having a foot extending horizontally outwardly therefrom, a foot of one of said plurality of legs being separate from a foot of an adjacent leg, said receiving area and said plurality of legs being integrally formed together of a polymeric material, said foot having a generally planar bottom surface, said planar bottom surface having a projection extending downwardly therefrom, said projection having a point opposite said planar bottom of sufficient sharpness so as to engage a support surface upon which the chair is placed under load.

2. The chair of claim 1, said receiving area having a generally parabolic indentation formed therein.

3. The chair of claim 1, a first pair of said plurality of legs extending downwardly from an upper end of said receiving area and a second pair of said plurality of legs extending downwardly from a lower portion of said receiving area.

4. The chair of claim 3, said first plurality of legs extending in a plane transverse to said second plurality of legs.

5. The chair of claim 1, said legs being separate from each other below said receiving area.

6. The chair of claim 1, each of said plurality of legs having the foot extending outwardly therefrom in a generally L-shaped configuration.

7. The chair of claim 1, said projection having an inverted pyramidal configuration.

8. The chair of claim 1, said planar bottom surface having a first projection adjacent an inner edge and a second projection adjacent an outer edge of said planar bottom surface.

9. The chair of claim 1, said projection being integrally formed with said foot.

10. The chair of claim 1, said polymeric material being a glass-filled nylon material.

* * * * *